US007182026B2

(12) United States Patent
Birkenmayer

(10) Patent No.: US 7,182,026 B2
(45) Date of Patent: Feb. 27, 2007

(54) PALLET

(75) Inventor: Roland Anton Birkenmayer, Johannesburg (ZA)

(73) Assignee: E-Dek Investments (Pty) Ltd. (ZA)

( * ) Notice: Subject to any disclaimer, the term of this patent is extended or adjusted under 35 U.S.C. 154(b) by 296 days.

(21) Appl. No.: 10/479,387

(22) PCT Filed: May 30, 2002

(86) PCT No.: PCT/ZA02/00091

§ 371 (c)(1),
(2), (4) Date: Apr. 27, 2004

(87) PCT Pub. No.: WO02/096766

PCT Pub. Date: Dec. 5, 2002

(65) Prior Publication Data

US 2004/0168617 A1 Sep. 2, 2004

(30) Foreign Application Priority Data

May 31, 2001 (ZA) ..... 01/4473

(51) Int. Cl.
*B65D 19/00* (2006.01)

(52) U.S. Cl. ..... 108/51.11; 108/902; 108/901

(58) Field of Classification Search ..... 108/57.25, 108/56.1, 51.11, 901, 902, 57.29, 57.14; 248/346.02; 206/386, 595, 596, 598, 599, 206/600

See application file for complete search history.

(56) References Cited

U.S. PATENT DOCUMENTS

| | | | | |
|---|---|---|---|---|
| 3,910,204 | A * | 10/1975 | Jesse | 108/55.5 |
| 4,869,179 | A * | 9/1989 | Sammons et al. | 108/56.1 |
| 4,895,080 | A * | 1/1990 | Thomas | 108/56.1 |
| 5,333,555 | A | 8/1994 | McPhee | |
| 5,419,386 | A * | 5/1995 | Magro et al. | 160/232 |
| 5,440,998 | A * | 8/1995 | Morgan et al. | 108/57.18 |
| 5,636,577 | A * | 6/1997 | Gow | 108/57.17 |
| 6,220,558 | B1 * | 4/2001 | Broder et al. | 248/346.02 |
| 6,668,734 | B2 * | 12/2003 | Lucas et al. | 108/51.11 |
| 6,938,559 | B2 * | 9/2005 | Wullenweber | 108/57.25 |
| 2006/0168855 | A1 * | 8/2006 | D'Urban Jackson | 40/584 |

FOREIGN PATENT DOCUMENTS

| | | |
|---|---|---|
| GB | 1388759 | 3/1975 |
| GB | 2312415 | 10/1997 |
| JP | 04006042 | 1/1992 |

* cited by examiner

*Primary Examiner*—Janet M. Wilkens
(74) *Attorney, Agent, or Firm*—McGlew & Tuttle, PC

(57) ABSTRACT

A pallet which is made from elongate steel members of arcuate cross section which are welded together to form a frame, and plastic slats which are engaged with a snap action with the steel members and which form a planar upper surface for the pallet.

12 Claims, 2 Drawing Sheets

PALLET

BACKGROUND OF THE INVENTION

This invention relates to a pallet.

Pallets have traditionally been made from timber. The use of timber in a world which is increasingly sensitive to ecological factors, is becoming unacceptable. Timber also carries with it the risk of transferring diseases and insect pests, a danger which is compounded by the use of timber pallets in international trade.

As an alternative to timber pallets is known to make pallets from a plastics material. Thermoplastic materials, which are recyclable, do however display a number of disadvantages such as an unfavourable cost to strength ratio, the existence of a creep characteristic which leads to an over-design situation with a resulting higher cost, and the requirement to make use of flame retardants, which are expensive, to minimize fire hazards. Thermosetting plastic materials on the other hand are not recyclable and, generally, are subject to slow and costly manufacturing techniques.

All-steel pallets have been used but have only enjoyed limited success. Steel pallets are heavy and consequently are expensive. In an attempt to address the weight problem it has been proposed to make pallets from mesh, eg. welded wire mesh. A problem which arises in this connection is that it is difficult to achieve a predetermined ratio, of the order of 40%, of the bottom surface area to the upper surface area of the pallet. This is necessary to reduce stress concentrations when pallets are stacked one on the other.

It has also been proposed to make use of recycled rubber which is bonded to steel sections to make a composite pallet. The resulting construction is however heavy and can be expensive.

A need exists for a pallet which does not host insects and which is relatively inexpensive, robust and with good loading characteristics.

SUMMARY OF INVENTION

The invention provides a pallet which includes a frame formed by a plurality of elongate metallic elements, and a plurality of slats which are engaged with the elements.

The slats may be engaged with the elements to form a substantially planar upper surface and a lower support surface or surfaces.

The slats may be made from an appropriate plastics material for example by means of a moulding process.

The slats may be engaged with the elements in any appropriate way and preferably are engaged with a snap fit with the elements. To achieve this the slats and the metallic elements may include interengaging complementary formations.

Each slat may be of any appropriate size and shape and, in a preferred example, each slat has a planar upper surface with a plurality of underlying reinforcing ribs or similar formations. To reduce weight and the consumption of material each slat may be formed with one or more openings.

Each slat may be made from any appropriate material such as polyethylene, polypropylene or polyurethane. The choice of material depends however on a number of requirements including cost, durability, weight, resistance to ageing and the like. The scope of the invention is consequently not limited by the choice of material.

The upper surface of each slat may be roughened, in any appropriate way, to display a desirable coefficient of friction. This helps to ensure that a product placed on the slats remains in position. The upper surface may be sandblasted but preferably is moulded with a roughened upper surface defined for example by small projections on the upper surface.

Each elongate metallic element may have any appropriate cross sectional shape. In a preferred form of the invention though each element has an arcuate cross section ie. concave and convex outer surfaces. The arcuate cross section of the elongate metallic element may subtend any appropriate angle which may vary according to requirement and which typically is in the range of from 150° to 170°.

Within the frame the elongate metallic elements are oriented to provide maximum strength. Each elongate metallic element is preferably oriented so that its width is positioned in a vertical orientation, in use of the pallet.

Preferably each elongate metallic element is made from high tensile steel.

The elements may be secured to each other in any appropriate way and for example are fixed to each other by means of welding.

BRIEF DESCRIPTION OF THE DRAWINGS

The invention is further described by way of examples with reference to the accompanying drawings in which.

DESCRIPTION OF PREFERRED EMBODIMENTS

Figure 1:
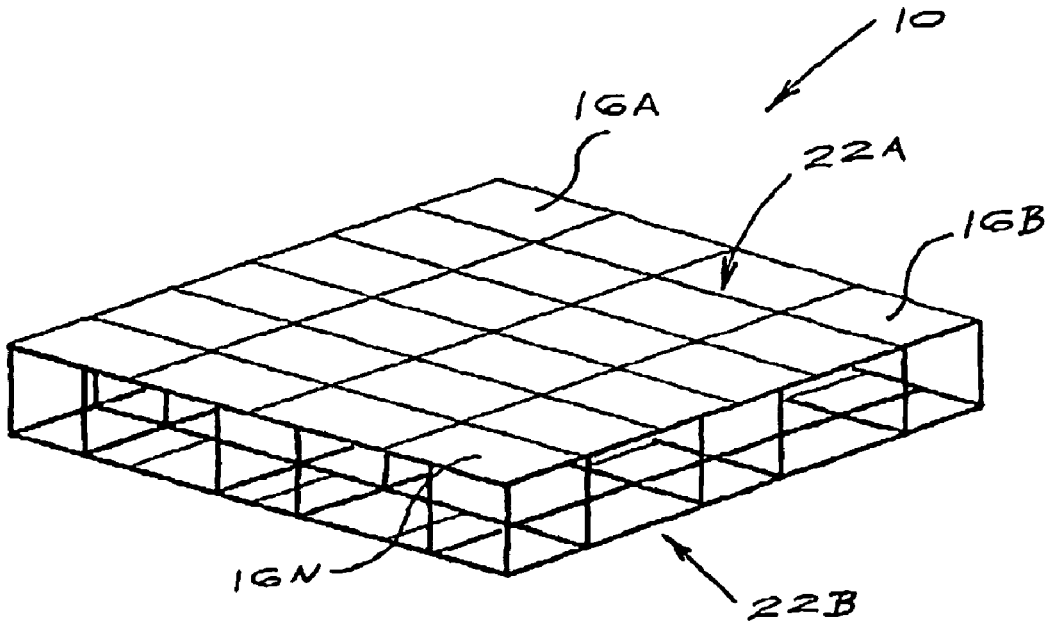
FIG. 1 is a perspective view of a full perimeter base pallet according to the invention.
Figure 2:
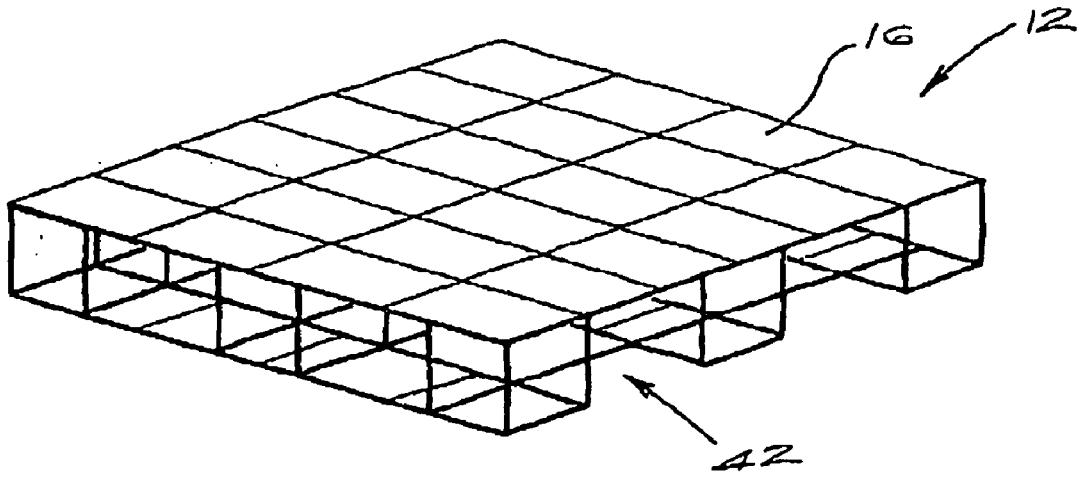
FIG. 2 is a perspective view of a skid-type pallet made using the principles of the invention.

FIGS. 1 and 2 respectively illustrate a full perimeter base pallet 10 and a skid-type pallet 12 made, in each instance, using the principles of the invention. Overall the pallets 10 and 12 are substantially conventional in appearance although it is to be noted that each pallet on an upper surface has a tile-like or slat-like appearance.

Figure 3:
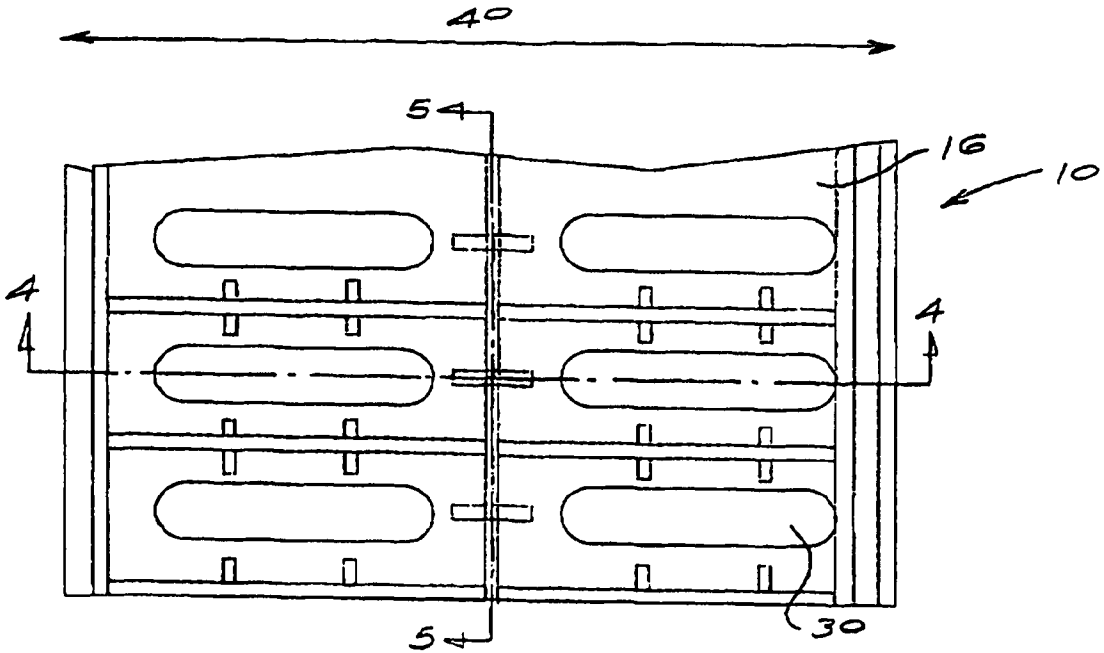
FIG. 3 is an enlarged plan view of a portion of a pallet according to the invention.

FIG. 3 is a plan view of a portion of the pallet 10, on an enlarged scale. It is to be understood though that the following description applies equally to the construction of the pallet 12.

Figure 5:
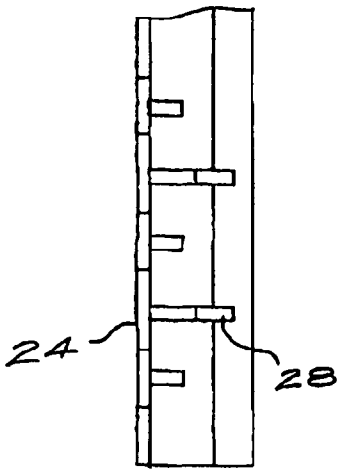
FIG. 5 is a cross sectional view of the pallet portion shown in FIG. 3 taken on a line 5—5.
Figure 4:
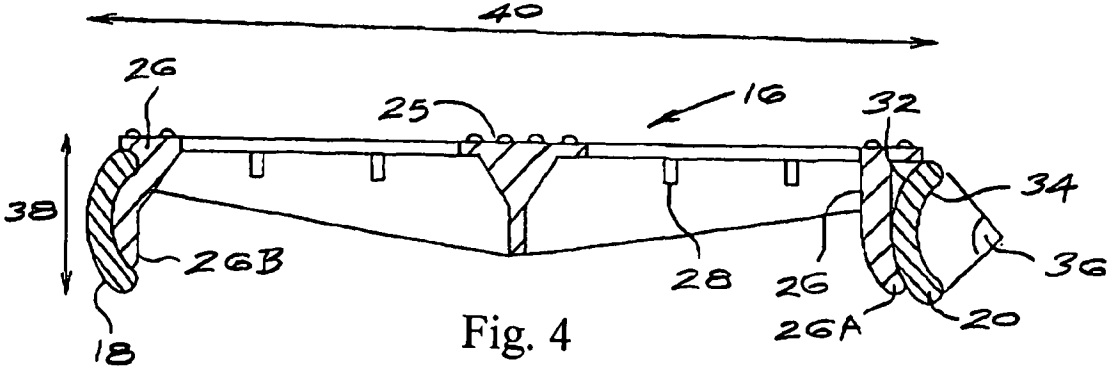
FIG. 4 is a cross sectional side view of the pallet portion shown in FIG. 3 taken on a line 4—4.

FIGS. 3, 4 and 5 illustrate a plastic slat 16 which is engaged with spaced steel elements 18 and 20 respectively.

The slat 16 is one of a plurality of slats, see FIG. 1, which make up a substantially planar upper surface 22A of the pallet 11 and which are designated 16A, 16B . . . 16N respectively. On its under side 22B, not visible in FIG. 1, the pallet 10 also has a number of slats which face downwardly. The number of slats on the underside is substantially less than the number of slats on the upper side.

Each slat is moulded from a suitable plastics material such as polypropylene. The slat has a planar upper surface 24 which is roughened by means of integrally moulded projections 25 so that it possess a suitable coefficient of friction, downwardly depending sides 26, and a plurality of reinforcing ribs 28 on its underside. Elongate slots 30 are formed through the planar surface of the slat at regular intervals. This reduces the weight of the slat without compromising its strength.

The sides 26 of the slat are arcuate in shape. The side on the right in FIG. 4, designated 26A, has a concave outer surface while the side on the left in FIG. 4, designated 26B, has a convex outer surface.

The elements 18 and 20 are made from high tensile steel. It is apparent, particularly from FIG. 4, that each element has an arcuate cross section with a convex outer surface 32 and a convex inner surface 34. The inner and outer surfaces subtend an angle 36, at the centre of curvature, which lies between 150° and 170°. A typical value is of the order of 150°.

The steel elements are welded to each other in a lattice-type configuration to form a frame. As far as is possible the elements are oriented, as shown in FIG. 4, so that the width 38 of each element is in a vertical orientation. The elements are spaced from each other by a distance 40 which is effectively the width of a slat 16.

Referring again to FIG. 1 the elements, on the sides of the pallet, are spaced to define openings 42, of predetermined dimensions, which allow the ingress of forks of a fork lifter or similar appliance so that the pallet and its load can be handled. A similar observation applies to the skid-type pallet 12. These aspects are however known in the art and consequently are not further described in detail.

The construction which has been described for the upper side 22A of the pallet applies equally to the lower side 22B although, as noted, the number of slats used on the underside is significantly less than the number of slats used on the upper side. To ensure that stress concentrations, in use, do not exceed predetermined maximum values, the total surface area of the slats on the underside should be at least approximately 40% of the total surface area of the slats on the upper side of the pallet.

In order to form the steel frame the steel elements are placed in a jig and are then welded to each other using any appropriate welding technique eg. robotic welding. The resulting frame is then galvanised or otherwise protected against corrosion. The slats 16, which are premoulded, are then engaged with a snap action into the respective openings formed in the steel frame. Each slat engages with the steel frame in the manner shown in FIG. 4. Once all of the slats have been engaged with the frame the pallet is ready for use.

The pallet of the invention has a number of benefits. Through suitable design the pallet can be constructed to take a load of up to two tons. This compares favourably to the loading capacity of a conventional timber pallet which is typically of the order of 1,5 tons.

The composite steel/plastic construction is inert to insects and has a good strength to mass relationship, has a long life, can be recycled when necessary, and is not subjected to splintering or rotting. Although the pallet can be recycled it has minimal scrap value. This reduces its attractiveness as a theft target.

The ratio of the mass of the pallet to its load carrying capacity is significantly better than the corresponding ratio for a timber pallet.

The pallet does not display creep with time or temperature under normal operating conditions and it can be manufactured in large volumes. The pallet can be refurbished when necessary simply by replacing broken slats or by welding or replacing damaged metallic elements, as the case may be.

The steel elements are, wherever possible, oriented so that the width 38 of each element is vertical. However to allow the forks of a fork lifter to enter the apertures 42, without snagging, rounded surfaces of the elements may be used to define perimeters of the apertures, or other steel members may be used.

The invention claimed is:

1. A pallet which includes a plurality of elongate metallic elements which are secured to one another to form a frame, each element having concave and convex outer surfaces, and a plurality of slats, each slat having two opposed sides which are respectively convex and concave and which are engageable, with a snap fit, with respective concave and convex outer surfaces of two adjacent elements.

2. A pallet according to claim 1, wherein the slats are engaged with the elements to form a substantially planar upper surface.

3. A pallet according to claim 1, wherein the slats are engaged with the elements to form a lower support surface or surfaces.

4. A pallet according to claim 1, wherein the slats are made from a plastics material.

5. A pallet according to claim 1, wherein the opposed sides of each slat includes formations which are respectively complementary to the concave and convex outer surfaces of the elements.

6. A pallet according to claim 1, wherein each slat has a planar upper surface with a plurality of underlying reinforcing formations.

7. A pallet according to claim 1, wherein each slat is formed with one or more openings.

8. A pallet according to claim 1, wherein each slat has a roughened upper surface.

9. A pallet according to claim 1, wherein the concave outer surface of each metallic element subtends an angle which is in the range of from 150° to 170°.

10. A pallet according to claim 1, wherein each elongate metallic element is oriented so that its width is positioned in a vertical orientation, in use.

11. A pallet according to claim 1, wherein each elongate metallic element is made from high tensile steel.

12. A pallet according to claim 1, wherein the frame is formed by welding the metallic elements together.

* * * * *